US005086824A

United States Patent [19]

Tsuda et al.

[11] Patent Number: 5,086,824

[45] Date of Patent: Feb. 11, 1992

[54] METHOD AND SYSTEM OF SENSING ABNORMALITIES IN A DEGASSING FLOW PATH OF A VACUUM DIE CASTING MACHINE

[75] Inventors: Akihiko Tsuda; Norihiro Iwamoto, both of Zama, Japan

[73] Assignee: Toshiba Kikai Kabushiki Kaisha, Tokyo, Japan

[21] Appl. No.: 366,921

[22] Filed: Jun. 16, 1989

[30] Foreign Application Priority Data

Jun. 27, 1988 [JP] Japan ..... 63-158286

[51] Int. Cl.[5] ..... B22D 17/32

[52] U.S. Cl. ..... 164/4.1; 164/150

[58] Field of Search ..... 164/4.1, 457, 150

[56] References Cited

FOREIGN PATENT DOCUMENTS 58-128256 7/1983 Japan ..... 164/150
61-209761 9/1986 Japan ..... 164/457
63-3925 1/1988 Japan ..... 164/150

*Primary Examiner*—Richard K. Seidel
*Attorney, Agent, or Firm*—Cushman, Darby & Cushman

[57] ABSTRACT

A method and system is described for sensing an abnormality in a degassing flow path of a vacuum die casting machine. When a vacuum device is operated to degas a gas in a cavity of a mold, a gas speed flowing through a piping is detected. The gas speed thus detected is compared with the predetermined maximum proper air speed value to determine whether the maximum gas speed value falls into the tolerance limits of the maximum proper air speed value or not. In this comparison, when the detected value departs from the tolerance limits, it is regarded that a clogging has occurred in the degassing system and an alarm is issued.

10 Claims, 4 Drawing Sheets

METHOD AND SYSTEM OF SENSING ABNORMALITIES IN A DEGASSING FLOW PATH OF A VACUUM DIE CASTING MACHINE

BACKGROUND OF THE INVENTION

1. Field of the Invention

The present invention relates to a method of sensing an abnormality in a degassing flow path of a vacuum die casting machine and a system therefore, and more particularly to a method of sensing an obstruction in pipes and filters comprising the degassing flow path of the die casting machine and a system therefore.

2. Description of the Related Art

FIG. 4 shows a schematic arrangement of a system of the conventional vacuum die casting machine. A movable mold part 1 is linearly movable to and from a stationary mold part 2 by a drive device, not shown. When the movable mold part 1 and the stationary mold part 2 are abutted against each other, a cavity 6 is defined. An injection sleeve 3 communicates with the cavity 6 and is connected to the stationary mold part 2. An injection plunger 4 driven by an injection cylinder device 5, for injecting molten metal into the cavity 6 is provided in the injection sleeve 3. In a degassing hole 7 formed between the mold parts 1 and 2, there is provided a vacuum valve device 8 so as to be communicated with the cavity 6. This vacuum valve device 8 functions such that the device 8 discharges gas in the cavity 6 prior to injection of the molten metal into the cavity 6 and closes at the time of injection of the molten metal. The vacuum valve device 8 comprises an on-off valve 9 provided in the degassing hole 7 and a cylinder 10 for linearly moving the on-off valve 9. The cylinder 10 is adapted to be driven by the switching action between a solenoid 11A and a solenoid 11B of a solenoid valve 11. The switching action between the solenoids 11A and 11B in the solenoid valve 11 is controlled in response to output signals of first and second limit switches 13 and 14 which are engaged with a dog (not shown) provided on the injection plunger 4. More specifically, in response to the output signal from the first limit switch 13 when the first limit switch 13 is engaged with the dog, the solenoid 11A is operated to open the on-off valve 9 for preparation of degassing the gas in the cavity 6. On the other hand, in response to the output signal from the second limit switch 14 when the second limit switch 14 is engaged with the dog, the solenoid 11B is operated to close the on-off valve 9, so that the molten metal is injected into the cavity 6 in this state.

A vacuum pump 22 is connected to the vacuum valve device 8 through pipes 20 and 21. The gas in the cavity 6 discharged through the vacuum valve device 8 is discharged by the vacuum pump 22. In the intermediate portions of the pipes 20 and 21, which connect the vacuum valve device 8 and the vacuum pump 22, there are provided a filter 23, a solenoid valve 24, a tank 25 and a solenoid valve 26. Here, the pipes 20, 21, the vacuum pump 22, the solenoid valves 24, 26, the tank 25 and the like comprise a vacuum system.

A solenoid valve 27 is branched from a portion between the solenoid valve 26 and the vacuum pump 22. In response to a pressure detected by a pressure switch 28 secured to the tank 25, the solenoid valve 27 is operated to control the degree of vacuum in the pipes 20 and 21.

However, in the degassing system in the conventional vacuum die casting machine, degassing of the gas from the cavity is intermittently performed under predetermined operating conditions, and a cast product is molded in this state, thus presenting the following problems.

More specifically, in accordance with a predetermined casting cycle, the vacuum valve device 8, the vacuum pump 22 and the like are operated so that degassing of the gas from the cavity 6 can be performed. However, even if changes with time occur in the degassing state as the casting cycle proceeds, these changes cannot be sensed.

Accordingly, when clogging occurs in the pipes 20, 21 or the like which comprise the degassing flow path, a predetermined degassing cannot be achieved. Since the cause and effect relationship between the degassing accuracy and the quality of the cast product is strong, resulting in considerable variations in the characteristics of the cast products thus obtained. As a result, occurrence of a multiplicity of defects cannot be avoided.

SUMMARY OF THE INVENTION

It is an object of the present invention to provide a method and system for sensing an abnormality in a degassing flow path of a vacuum die casting machine, wherein, by sensing the degassed state in a vacuum die casting machine, variations in the casting conditions are precisely monitored to obtain uniform cast products, and, when an abnormality occurs, a worker is immediately informed of the abnormality to prevent defective parts.

To achieve the above-described object, a method of sensing an abnormality in a degassing flow path of a vacuum die casting machine according to the invention features at least one air speed sensor for sensing a discharge air speed is provided in a piping system of the vacuum system, which communicates with the degassing flow path of a mold. Air speed and/or a change pattern in air speed sensed by the air speed sensor or sensors is compared with a predetermined air speed and/or a change pattern in air speed, and, when the result of the comparison departs from a predetermined range of tolerance, it is regarded that an abnormality has occurred in the degassing flow path and a predetermined abnormality signal is issued.

To achieve the above-described object, the system for working the above described method according to the invention is characterized by including: a vacuum system communicating with the degassing flow path of the mold; at least one air speed sensor provided in a piping system of the vacuum system for sensing a discharge air speed; a comparing process means for comparing an air speed and/or a change pattern in air speed sensed by the air speed sensor or sensors with a predetermined proper air speed and/or a predetermined proper change pattern in air speed and for issuing an abnormality signal, when the result of the comparison departs from a predetermined range of tolerance and it is regarded that an abnormality has occurred in the degassing flow path; a means for inputting the predetermined proper air speed and/or the predetermined proper change pattern in air speed into this comparing process means; and an informing means operated in response to an output signal from the comparing process means.

According to the invention, an air speed at the time of degassing the gas from the cavity is sensed by the air speed sensor. The air speed thus sensed is compared with the predetermined proper air speed. In this comparison, when the air speed thus sensed falls within the predetermined tolerance limits, the air speed is regarded as normal, whereas, when the air speed departs from the tolerance limits, it is regarded that an abnormality has occurred in the degassing flow path, and the informing means is operated.

BRIEF DESCRIPTION 0F THE DRAWINGS

DETAILED DESCRIPTION OF THE PREFERRED EMBODIMENT

Figure 1:
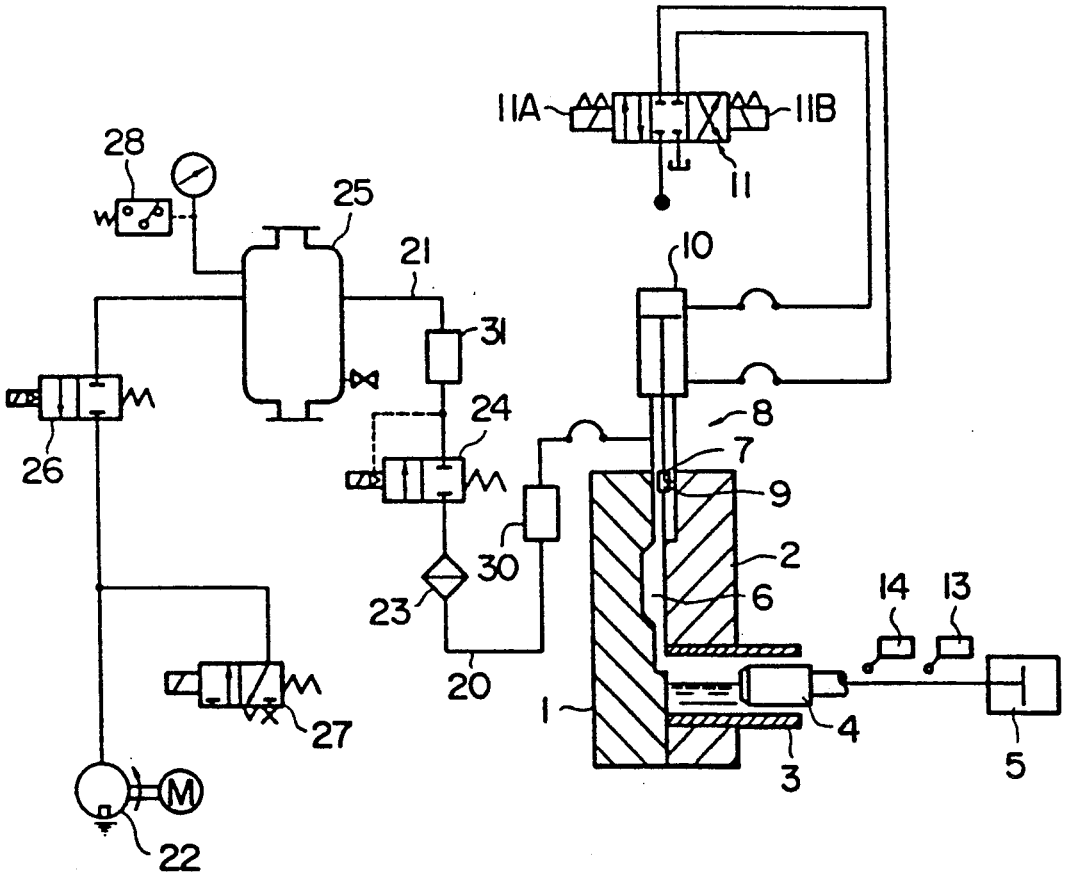
FIG. 1 is a schematic view showing the system in the vacuum die casting machine.

One embodiment of the present invention will hereunder be described with reference to FIG. 1.

In explaining this embodiment, like reference numerals are used to designate like parts in the conventional example, so that further description will be omitted or simplified.

A first air speed sensor 30 for measuring an air speed flowing through a piping 20 when the gas in the cavity 6 is degassed is provided in an intermediate portion of a pipe 20 which is connected to a vacuum system 8 and in front of a filter 23. A second air speed sensor 31 having the same function as the first air speed sensor 30 is provided in an intermediate portion of a pipe 21 and in front of a vacuum tank 25. These air speed sensors 30 and 31 are not of particularly limited types, but, in this embodiment, hot wire anemometers are used.

Figure 2:
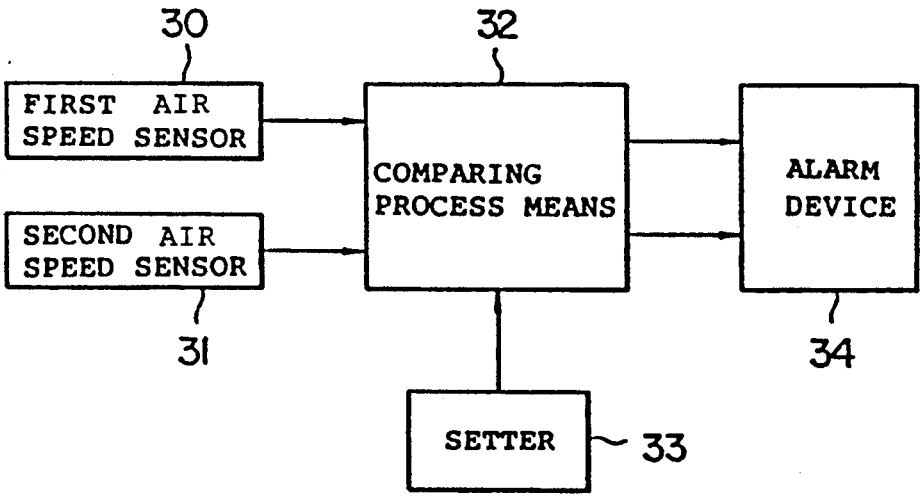
FIG. 2 is a circuit arrangement diagram for determining an abnormality.

As shown in FIG. 2, the first and the second air speed sensors 30 and 31 are adapted to give respective output signals to a comparing process means 32 provided at the next stage. This comparing process means 32 is additionally provided with a setter 33 as an input means, and, by this setter 33, the maximum suitable value at the time of degassing, which is determined in accordance with various casting conditions such as a volume of the mold cavity 6, the maximum suitable change pattern in air speed, the tolerance limits of error, and the like can be inputted. Connected to the comparing process means 32 is an alarm device 34 as an informing device, whereby, when the air speed sensed in the comparing process means 32 is determined to depart from the tolerance limits, an abnormality signal is issued, which activates the alarm device 34. In this case, as the modes of alarming, an acoustic alarm such as a buzzer or a lamp turn-on display are adopted. In order to easily specify the portion where the abnormality occurs, the alarm device 34 is preferably additionally provided with an identification lamp or the like which displays which of the air speed sensors sensed the abnormality.

Figure 3:
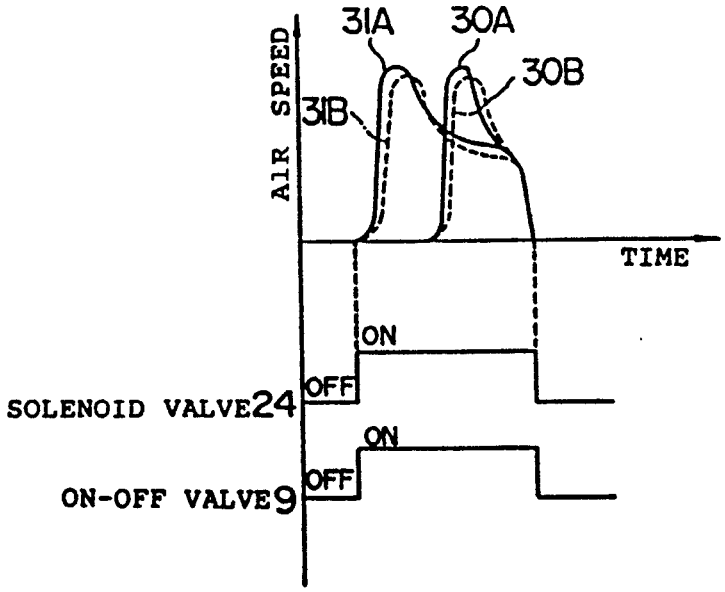
FIG. 3 is a chart showing the operation lines and an oscillograph of air speed change.
Figure 4:
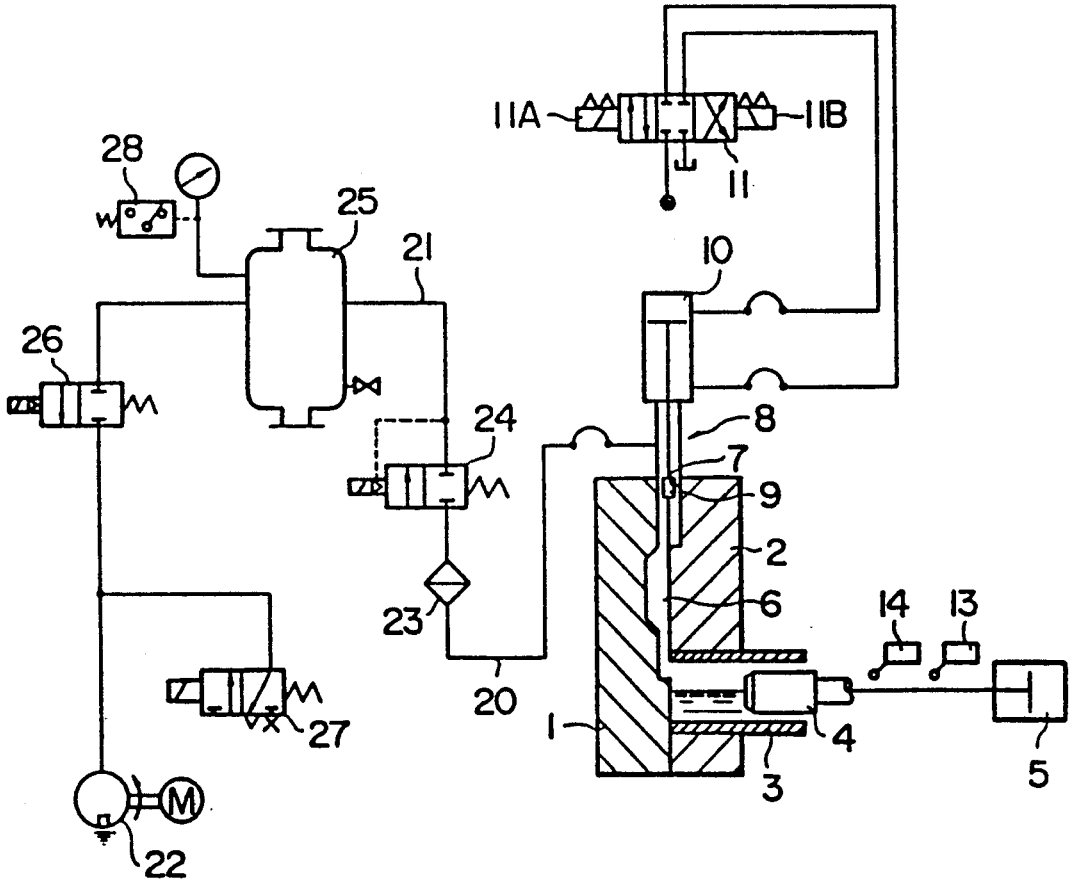
FIG. 4 (PRIOR ART)
FIG. 4 is a (prior art) schematic view showing conventional vacuum die casting machine and degassing system.

Action of this embodiment will hereunder be described with reference to FIG. 3.

Prior to the start of the casting cycle, through the setter 33. Such variables include the maximum suitable air speed values corresponding to the first and the second air speed sensors 30 and 31, the suitable change patterns as indicated by dotted lines 30B and 31B in FIG. 3 and further, the tolerance limits of error from a sensed air speed. In this case, the reason the air speed change 31B corresponding to the second air speed sensor 31 is set to appear prior to the air speed change 30B corresponding to the first aid speed sensor 30 is that the air speed sensor 31 is closer to the vacuum pump 22 and senses the change in air speed first.

Upon completion of the above-described setting, when the injection cylinder device 5 is driven from an initial state where the injection plunger 4 is in a retracted position so as to move the injection plunger 4 forward and the first limit switch 13 is engaged with the dog (not shown) to output a signal, the solenoid 11A of the solenoid valve 11 is operated so as to open the valve 9. At the same time, the solenoid valves 24 and 26 which are located at the intermediate portions of the pipes 20 and 21 are drawn vacuum by the vacuum pump 22, whereby the vacuum pump 22 is operated to discharge and the gas in the cavity 6 is discharged through the pipes 20 and 21. At this time, the air speeds of the gas flowing through the pipes 20 and 21 are sensed by the first and the second air speed sensors 30 and 31, grasped as 30A and 31A in FIG. 3 for example, and these changes in air speed thus sensed are successively input into the comparing process means 32.

The air speed values by the first and the second air speed sensors 30 and 31, which are input into the comparing process means 32, are compared with the previously input proper air speed values. In this embodiment, depending on whether the maximum air speed values of both air speed sensors 30 and 31 fall into the tolerance limits of the maximum proper air speed values or not, it is determined whether abnormalities such as clogging and the like have occurred in the pipes 20, 21 or the filter 23.

Here, when it is determined that the sensed air speeds depart from the predetermined tolerance limits, the comparing process means 32 inputs an abnormality signal into the alarm device 34, operating the buzzer for example, and also displays which of the air speed sensors 30 and 31 shows the abnormal value. On the basis of this, the worker performs necessary maintenance and inspection of the degassing system.

When no abnormality occurs, the valve 9 is closed, thereafter, the molten metal injected, and the normal casting cycle is continued as far as an abnormality is not sensed.

Since, in this embodiment, such an arrangement is adopted that the air speed sensors 30 and 31 are provided in the pipes 20 and 21 and the air speed values thus obtained are compared with the proper air speed values during the normal time, clogging and the like in the pipes 20 and 21 can be immediately known, and the degassed state in the cavity 6 can be constantly monitored. Accordingly, since casting can be carried out with the predetermined degassed state being maintained, molding of uniform cast products can be achieved.

Since, when an abnormality is sensed and the alarm device 34 is operated to inform the worker of the abnormality, such advantages can be offered that the operation of the machine is immediately stopped and occurrence of defective cast products is prevented in advance and necessary maintenance and inspection can be immediately carried out.

Further, since the air speed sensors 30 and 31 are provided at two positions on the pipes 20 and 21, an abnormality is determined depending on the respective air speed sensors 30 and 31, and the abnormality value shown by either one of the air speed sensors can be known through the alarm device 34, it is easily and correctly determined that clogging and the like have occurred in which portion of the pipes 20 and 21.

Since air speed sensors 30 and 31 adopt the well-known detectors, even if they are applied to the conventional construction, the manufacturing cost is not prohibitively high.

The locations of the air speed sensors 30 and 31 are not limited to those in the above embodiment, and the number of the air speed sensors may be desirably determined.

As the standard for detecting abnormalities description has been given of the example where the sensed maximum air speed value is compared with the preset maximum air speed value. However, the sensed air speed values are monitored with time and may be compared with a predetermined change pattern, whereby determination of an abnormality is performed from the mean value of an error.

As has been described hereinabove, the present invention can advantageously provide the method and system for sensing an abnormality in the degassing flow path of the vacuum die casting machine, wherein the degassed state in the vacuum die casting machine is sensed to precisely monitor changes in the casting conditions so that uniform cast products can be obtained. When an abnormality occurs, a worker is immediately informed of the abnormality so that defective parts can be prevented.

What is claimed is:

1. A method of sensing an abnormality in a degassing flow path of a vacuum die casting machine, the degassing flow path communicating a vacuum system with a mold cavity, the vacuum system for degassing a gas from the mold cavity, comprising the steps of:

sensing an air speed and a change pattern in air speed through the degassing flow path with at least one air speed sensor;

comparing the sensed air speed and air speed change pattern with a predetermined air speed and air speed change pattern;

issuing a predetermined abnormality signal if the sensed air speed and air speed change pattern are not within predetermined tolerance limits for the predetermined air speed and air speed change pattern.

2. The method of sensing an abnormality in a degassing flow path as in claim 1 wherein said comparing step compares the maximum value of the sensed air speed with a predetermined maximum value of air speed.

3. The method of sensing an abnormality in a degassing flow path as in claim 1, wherein said comparing step compares the sensed change pattern in air speed with the predetermined change pattern in air speed so as to determine whether a mean value of errors falls within the tolerance limits or not.

4. The method of sensing an abnormality in a degassing flow path as in claim 1, wherein the step of sensing utilizes a plurality of air speed sensors and the occurrences of abnormalities can be linked to the respective air speed sensors.

5. The method of sensing an abnormality in a degassing flow path as in claim 1, wherein the abnormality signal is an acoustic signal.

6. A system for sensing an abnormality in a degassing flow path of a vacuum die casting machine, the degassing flow path communicating a vacuum system with a mold cavity, comprising:

at least one air speed sensor provided in the degassing flow path for sensing a discharge air speed;

comparing process means for comparing the air speed and a change pattern in air speed through the degassing flow path sensed by the at least one air speed sensor to a predetermined proper air speed and a predetermined proper change pattern in air speed through the degassing flow path and for issuing an abnormality signal to notify of an occurrence of an abnormality state in the degassing flow path when the result of comparison departs from a predetermined region of the tolerance limits;

means for inputting the predetermined proper air speed and the predetermined proper change pattern in air speed into said comparing process means; and informing means operated in response to an output signal from said comparing process means for informing of an abnormality.

7. The system for sensing an abnormality in a degassing flow path as in claim 6, wherein said comparing process means compares a sensed maximum air speed value with a predetermined maximum air speed value.

8. The system for sensing an abnormality in a degassing flow path as in claim 6, wherein said comparing process means compares the sensed change pattern in air speed with the predetermined change pattern in air speed so as to determine whether a mean value of error falls within the tolerance limits.

9. The system for sensing an abnormality in a degassing flow path as in claim 6, wherein a plurality of air speed sensors are provided and said informing means inform of occurrences of abnormalities corresponding to the respective air speed sensors.

10. The system for sensing an abnormality in a degassing flow path as in claim 6, wherein said informing means includes an alarm device for informing of a sensed abnormality.

* * * * *